US012396475B2

(12) United States Patent
Lavanant et al.

(10) Patent No.: US 12,396,475 B2
(45) Date of Patent: Aug. 26, 2025

(54) METHOD OF PRODUCING AN AEROSOL-GENERATING ELEMENT

(71) Applicant: Philip Morris Products S.A., Neuchatel (CH)

(72) Inventors: Laurent Lavanant, Neuchatel (CH); Ping Li, Neuchatel (CH); Gisèle Ongmayeb, Nantes (FR)

(73) Assignee: Philip Morris Products S.A., Neuchatel (CH)

( * ) Notice: Subject to any disclaimer, the term of this patent is extended or adjusted under 35 U.S.C. 154(b) by 537 days.

(21) Appl. No.: 17/773,808

(22) PCT Filed: Nov. 3, 2020

(86) PCT No.: PCT/EP2020/080816

§ 371 (c)(1),
(2) Date: May 2, 2022

(87) PCT Pub. No.: WO2021/089543

PCT Pub. Date: May 14, 2021

(65) Prior Publication Data

US 2022/0386680 A1 Dec. 8, 2022

(30) Foreign Application Priority Data

Nov. 4, 2019 (EP) ..... 19206991

(51) Int. Cl.

| | |
|---|---|
| ***A24B 15/167*** | (2020.01) |
| ***A24B 15/28*** | (2006.01) |
| ***A24B 15/32*** | (2006.01) |
| ***A24D 1/20*** | (2020.01) |

(52) U.S. Cl.

CPC ..... *A24B 15/167* (2016.11); *A24B 15/283* (2013.01); *A24B 15/32* (2013.01); *A24D 1/20* (2020.01)

(58) Field of Classification Search

None

See application file for complete search history.

(56) References Cited

U.S. PATENT DOCUMENTS

| | | | | |
|---|---|---|---|---|
| 2006/0144412 | A1 | 7/2006 | Mishra et al. | |
| 2007/0062550 | A1 | 3/2007 | John et al. | |
| 2011/0088708 | A1 | 4/2011 | John et al. | |
| 2011/0232656 | A1 | 9/2011 | Zeng et al. | |
| 2014/0360518 | A1 | 12/2014 | Besso | |
| 2015/0335070 | A1 | 11/2015 | Sears et al. | |
| 2016/0120225 | A1* | 5/2016 | Mishra | A24F 40/20 392/386 |
| 2016/0295910 | A1 | 10/2016 | Besso et al. | |
| 2017/0027218 | A1* | 2/2017 | Besso | A24B 15/303 |
| 2018/0014576 | A1 | 1/2018 | White | |
| 2018/0352862 | A1 | 12/2018 | Mironov et al. | |
| 2021/0015144 | A1 | 1/2021 | Capelli et al. | |

FOREIGN PATENT DOCUMENTS

| | | | |
|---|---|---|---|
| CN | 1870913 | A | 11/2006 |
| CN | 103813726 | A | 5/2014 |
| CN | 104470384 | A | 3/2015 |
| CN | 104824850 | A | 8/2015 |
| CN | 105813486 | A | 7/2016 |
| CN | 105899095 | A | 8/2016 |
| CN | 108669641 | A | 10/2018 |
| JP | 46-18599 | B | 5/1971 |
| JP | 2013-523420 | A | 6/2013 |
| JP | 2014-526240 | A | 10/2014 |
| JP | 2014-532435 | A | 12/2014 |
| JP | 2021-518135 | A | 8/2021 |
| RU | 2 670 541 | C2 | 10/2018 |
| WO | WO 2005/044026 | A1 | 5/2005 |
| WO | WO 2007/010407 | A2 | 1/2007 |
| WO | WO 2009/094859 | A1 | 8/2009 |
| WO | WO 2011/101164 | A1 | 8/2011 |

(Continued)

OTHER PUBLICATIONS

CN103813726A, "Smoking article comprising a flavour delivery material" (Year: 2014).*

National Institute of Medical Science, Bigler-Coyne: The Chemistry of Chocolate Published Feb. 12, 2020, site: https://biobeat.nigms.nih.gov/2020/02/the-chemistry-of-chocolate. Retrieved online Apr. 24, 2025. (2020).*

Eng-Seng Chan, et al., "Prediction models for shape and size of ca-alginate macrobeads produced through extrusion-dripping method", Journal of Colloid and Interface Science, Academic Press, Inc, US, vol. 388, No. 1, Oct. 1, 2009, pp. 63-72.

Su Hung Ching et al., "Alginate gel particles—A review of production techniques and physical properties", Critical Reviews in Food Science and Nutrition, vol. 57, No. 6, May 15, 2015, pp. 1133-1152.

(Continued)

*Primary Examiner* — Manley L Cummins, IV

(74) *Attorney, Agent, or Firm* — Oblon, McClelland, Maier & Neustadt, L.L.P.

(57) ABSTRACT

A method of producing an aerosol-generating element for an aerosol-generating article or system is provided, the method including the steps of: preparing a matrix polymer solution including a matrix-forming polymer in water; adding a plurality of aerosol-generating formulation components to the matrix polymer solution to form an aerosol-generating solution, in which the aerosol-generating formulation components include a polyhydric alcohol and at least one alkaloid or cannabinoid, and in which the aerosol-generating solution includes at least 0.5 percent by weight of the at least one alkaloid or cannabinoid; forming a discrete portion of the aerosol-generating solution; adding the discrete portion of the aerosol-generating solution to a cross-linking solution of multivalent cations to cross-link the matrix-forming polymer; and removing the aerosol-generating element from the cross-linking solution and drying the aerosol-generating element.

12 Claims, No Drawings

(56) References Cited

FOREIGN PATENT DOCUMENTS

| | | | | | |
|---|---|---|---|---|---|
| WO | WO 2012/164009 | A2 | | 12/2012 | |
| WO | WO 2013/034488 | A2 | | 3/2013 | |
| WO | WO 2013/068304 | A1 | | 5/2013 | |
| WO | WO 2015/101512 | A1 | | 7/2015 | |
| WO | WO 2015/123422 | A1 | | 8/2015 | |
| WO | WO 2016/069876 | A1 | | 5/2016 | |
| WO | WO 2016/120344 | A2 | | 8/2016 | |
| WO | WO 2018/234505 | A1 | | 12/2018 | |
| WO | WO 2019/073225 | A1 | | 4/2019 | |
| WO | WO 2019/086859 | A1 | | 5/2019 | |
| WO | WO 2019/135618 | A1 | | 7/2019 | |
| WO | WO-2019193208 | A1 | * | 10/2019 | ..... A24B 15/167 |
| WO | WO-2019193210 | A1 | * | 10/2019 | ..... A24B 15/167 |
| WO | WO 2020/025701 | A1 | | 2/2020 | |
| WO | WO 2020/207732 | A1 | | 10/2020 | |

OTHER PUBLICATIONS

International Search Report and Written Opinion mailed on May 2, 2021 in PCT/EP2020/080816 filed on Nov. 3, 2020 (10 pages).

Combined Russian Notice of Allowance and Search Report issued Nov. 15, 2023 in Russian Patent Application No. 2022114973/03 (with English Translation), 18 pages.

Extended European Search Report issued May 13, 2020, in corresponding European Patent Application No. 19206991.2, 10 pages.

Combined Chinese Office Action and Search Report issued Mar. 7, 2023, in corresponding Chinese Patent Application No. 202080075800.3 (with English Translation), 22 pages.

Chinese Notice of Allowance issued on Jul. 19, 2023 in Chinese Patent Application No. 202080075800.3 (with English translation), 7 pages.

Yunfei et al., "Preparation and Application of Microcapsule", Materials Report, vol. 12, Issue 4, 1998, pp. 50-52 (with English Abstract).

Japanese Office Action issued on Nov. 5, 2024 in Japanese Patent Application No. 2022-524984 (with unedited computer-generated English translation), 7 pages.

* cited by examiner

METHOD OF PRODUCING AN AEROSOL-GENERATING ELEMENT

The present invention relates to a method of producing an aerosol-generating element for use in an aerosol-generating article or aerosol-generating system. The present invention further relates to an aerosol-generating element produced by such a method.

Aerosol-generating articles in which an aerosol-generating substrate, such as a nicotine-containing substrate or a tobacco-containing substrate, is heated rather than combusted, are known in the art. Typically, in such heated smoking articles an aerosol is generated by the transfer of heat from a heat source to a physically separate aerosol-generating substrate or material, which may be located in contact with, within, around, or downstream of the heat source. During use of the aerosol-generating article, volatile compounds are released from the aerosol-generating substrate by heat transfer from the heat source and are entrained in air drawn through the aerosol-generating article. As the released compounds cool, they condense to form an aerosol.

A number of prior art documents disclose aerosol-generating devices for consuming aerosol-generating articles. Such devices include, for example, electrically heated aerosol-generating devices in which an aerosol is generated by the transfer of heat from one or more electrical heater elements of the aerosol-generating device to the aerosol-generating substrate of a heated aerosol-generating article.

Substrates for heated aerosol-generating articles have, in the past, often been produced using randomly oriented shreds, strands, or strips of tobacco material. As an alternative, rods for heated aerosol-generating articles formed from gathered sheets of tobacco material have been disclosed, by way of example, in international patent application WO-A-2012/164009.

International patent application WO-A-2011/101164 discloses alternative rods for heated aerosol-generating articles formed from strands of homogenised tobacco material, which may be formed by casting, rolling, calendering or extruding a mixture comprising particulate tobacco and at least one aerosol former to form a sheet of homogenised tobacco material. In alternative embodiments, the rods of WO-A-2011/101164 may be formed from strands of homogenised tobacco material obtained by extruding a mixture comprising particulate tobacco and at least one aerosol former to form continuous lengths of homogenised tobacco material.

Alternative forms of substrates comprising nicotine have also been disclosed. By way of example, liquid nicotine compositions, often referred to as e-liquids, have been proposed. These liquid compositions may, for example, be heated by a coiled electrically resistive filament of an aerosol-generating device. Substrates of this type may require particular care in the manufacture of the containers holding the liquid composition in order to prevent undesirable leakages.

It has been previously proposed to provide an encapsulated nicotine formulation for use as an aerosol-generating substrate. However, the encapsulation of nicotine formulations has been found to be challenging. One of the reasons for this is the preference for hydrophilic aerosol formers, such as glycerin and propylene glycol, in the nicotine formulation, which makes it difficult to encapsulate the formulation with commonly used hydrophilic encapsulation materials. With existing encapsulation techniques, it has generally been found that a very high level of the hydrophilic encapsulation material is required in order to produce a stable product. This in turn means that an insufficient amount of the nicotine formulation is provided per unit volume, resulting in an inefficient delivery of aerosol from the encapsulated substrate.

Whilst hydrophobic encapsulation materials are available, such materials often need to be processed at relatively high temperature, which risks the degradation of the nicotine formulation during manufacture. During use, the temperatures required to generate an aerosol from the nicotine formulation may be sufficiently high to cause degradation of the hydrophobic encapsulation material. This may result in the release of undesirable compounds into the resultant aerosol, which may have an adverse impact on the sensory profile of the aerosol.

It would be desirable to provide a novel method of producing an encapsulated aerosol-generating formulation, such as a nicotine containing formulation, which provides an improved encapsulated substrate having increased stability and minimal leakage of the aerosol-generating formulation. It would be particularly desirable to provide such a method that produces an encapsulated substrate having a maximised payload of the aerosol-generating formulation with minimal encapsulating material, so as to provide an efficient aerosol delivery. Additionally, it would be desirable to provide such a method that produces an encapsulated substrate that gives a controlled delivery of aerosol upon heating. It would be further desirable to provide a method that produces an encapsulated substrate in a form that can be readily incorporated into an aerosol-generating article or device and readily heated in order to generate an aerosol According to the present invention there is provided a method for producing an aerosol-generating element comprising the steps of: preparing a matrix polymer solution comprising a matrix-forming polymer in water; adding a plurality of aerosol-generating formulation components to the matrix polymer solution to form an aerosol-generating solution, wherein the aerosol-generating formulation components comprise a polyhydric alcohol and at least one alkaloid or cannabinoid; forming a discrete portion of the aerosol-generating solution; adding the discrete portion of the aerosol-generating solution to a cross-linking solution of multivalent cations to cross-link the matrix-forming polymer, thereby forming an aerosol-generating element having a continuous polymer matrix and an aerosol-generating formulation comprising the aerosol-generating formulation components dispersed within the continuous polymer matrix; and removing the aerosol-generating element from the cross-linking solution and drying the aerosol-generating element.

The method as defined forms an aerosol-generating element having a continuous polymer matrix and an aerosol-generating formulation comprising the aerosol-generating formulation components dispersed within the continuous polymer matrix.

According to the present invention there is further provided an aerosol-generating element produced according to the method of the present invention, as defined above, the aerosol-generating element comprising at least 60 percent by weight of polyhydric alcohol, at least 0.5 percent by weight of nicotine and at least 0.5 percent by weight of acid.

As used herein, the term "aerosol-generating article" refers to an aerosol-generating article for producing an aerosol comprising an aerosol-generating substrate that is intended to be heated rather than combusted in order to release volatile compounds that can form an aerosol.

As used herein, the term "aerosol-generating element" refers to a discrete aerosol-generating substrate in solid form, comprising the aerosol-generating formulation dispersed and encapsulated within a cross-linked polymer matrix. The structure and composition of the aerosol-generating element will be described in more detail below.

An aerosol-generating element in accordance with the present invention may find use as an aerosol-generating substrate of an aerosol-generating article.

As used herein, the term "aerosol-generating substrate" refers to a substrate capable of releasing upon heating volatile compounds, which can form an aerosol. In the present invention, the aerosol-generating substrate is in the form of an aerosol-generating element encapsulating an aerosol-generating formulation comprising at least one alkaloid or cannabinoid and a polyhydric alcohol. The aerosol generated from the aerosol-generating formulation of aerosol-generating elements described herein is a dispersion of solid particles or liquid droplets (or a combination of solid particles and liquid droplets) in a gas. The aerosol may be visible or invisible and may include vapours of substances that are ordinarily liquid or solid at room temperature as well as solid particles or liquid droplets or a combination of solid particles and liquid droplets.

A conventional cigarette is lit when a user applies a source of ignition to one end of the cigarette and draws air through the other end. The localised heat provided by the flame and the oxygen in the air drawn through the cigarette causes the end of the cigarette to ignite, and the resulting combustion generates an inhalable smoke. By contrast, in heated aerosol-generating articles, an aerosol is generated by heating a flavour generating substrate, such as, for example, a tobacco-based substrate or a substrate containing an aerosol-former and a flavouring. Known heated aerosol-generating articles include, for example, electrically heated aerosol-generating articles and aerosol-generating articles in which an aerosol is generated by the transfer of heat from a combustible fuel element or heat source to a physically separate aerosol forming material.

For example, aerosol-generating articles according to the invention may find particular application in aerosol-generating systems comprising an electrically heated aerosol-generating device having an internal heater which is adapted to supply heat to one or more discrete aerosol-generating substrate elements. As used herein with reference to the present invention, the term "aerosol-generating device" is used to describe a device comprising a heater element that interacts with one or more aerosol-generating elements in accordance with the invention to produce an aerosol. During use, volatile compounds are released from the aerosol-generating element or elements by heat transfer and entrained in air drawn through the aerosol-generating article. As the released compounds cool they condense to form an aerosol that is inhaled by the consumer.

Substrates for heated aerosol-generating articles typically comprise an "aerosol former", that is, a compound or mixture of compounds that, in use, facilitates formation of the aerosol, and that preferably is substantially resistant to thermal degradation at the operating temperature of the aerosol-generating article. Examples of suitable aerosol-formers include: polyhydric alcohols, such as propylene glycol, triethylene glycol, 1,3-butanediol and glycerin; esters of polyhydric alcohols, such as glycerol mono-, di- or triacetate; and aliphatic esters of mono-, di- or polycarboxylic acids, such as dimethyl dodecanedioate and dimethyl tetradecanedioate.

The polyhydric alcohol in the aerosol-generating formulation of the aerosol-generating element produced according to the invention is also an aerosol former within the meaning set out above.

As used herein, the term "aerosol-generating formulation" refers to a formulation comprising a plurality of aerosol-generating formulation components, which upon heating of the aerosol-generating element will volatilise to produce an aerosol. The "aerosol-generating solution" produced during the method of the present invention refers to a solution of the aerosol-generating formulation components and the matrix-forming polymer, in an appropriate solvent.

As used herein, the term "matrix-forming polymer" refers to an encapsulation material in the form of a polymer which is capable of producing a three-dimensional polymer matrix as a result of cross-linking when the matrix-forming polymer is brought into contact with a cross-linking solution of multivalent cations. The resultant polymer matrix is capable of trapping and retaining the aerosol-generating formulation within its cross-linked structure. The nature of the cross-linked polymer matrix will be discussed in more detail below.

As described above, the present invention provides a novel method for producing an aerosol-generating element, in which an aerosol-generating formulation is encapsulated within a continuous polymer matrix structure. The aerosol-generating element produced according to the invention provides a stable structure in which the aerosol-generating formulation can be retained effectively, with minimal loss of the aerosol-generating formulation components during manufacture or storage of the aerosol-generating element.

Advantageously, the method according to the invention enables an effective encapsulation of the aerosol-generating formulation to be provided using a significantly lower level of the encapsulation material, (corresponding to the matrix-forming polymer), than has been previously possible. This enables the levels of the aerosol-generating formulation components, such as the alkaloid or cannabinoid and the polyhydric alcohol, to be maximised within the aerosol-generating element. Further, the reduction in the proportion of encapsulation material required enables the aerosol to be generated more efficiently upon heating, since less heating of the encapsulation material takes place.

The polymer matrix of the aerosol-generating element provides an inert encapsulation structure for retaining and immobilising the aerosol-generating formulation, which is stable upon heating of the aerosol-generating element during use. The inventors have found that, when heated to temperatures in the range from 150 degrees Celsius to 350 degrees Celsius, aerosol-generating elements produced in accordance with the present invention release an aerosol as they undergo a significant weight loss. This weight loss is not, however, accompanied by an equally significant volume loss. Without wishing to be bound by theory, it is understood that, upon heating, components of the aerosol-generating formulation originally dispersed and trapped within the continuous polymer matrix structure are substantially vaporised and released. On the other hand, components of the continuous polymer matrix structure are substantially unaffected and the continuous polymer matrix only partially shrinks while essentially retaining its 3D structure. As such, the encapsulation of the aerosol-generating formulation within the polymer-based matrix advantageously provides minimal or no adverse effects on the sensory profile of the aerosol generated upon heating.

The aerosol-generating element produced by the method of the present invention has been found to advantageously provide a controlled delivery of aerosol. Furthermore, the aerosol delivery profile can be readily adjusted by controlling different parameters of the production method. For example, the aerosol delivery profile may be adjusted by altering the method to control parameters of the aerosol-generating element such as the size, shape, structure and formulation of the aerosol-generating element.

The aerosol-generating element is in the form of a discrete, self-standing solid object which is sufficiently stable and robust that it can readily be processed and introduced into an aerosol-generating article using existing methods and techniques.

As defined above, in the method of producing an aerosol-generating element, an aerosol-generating solution is first prepared from a matrix polymer solution and the aerosol-generating formulation components. A discrete portion of the aerosol-generating solution is then added to a cross-linking solution to bring about the cross-linking of the matrix-forming polymer and the formation of the polymer matrix. The resultant aerosol-generating element is removed from the cross-linking solution and dried. Each of the method steps will now be described in more detail.

In a first step of the method of the present invention, a matrix polymer solution is formed, which is a solution of the matrix-forming polymer in water. Preferably, the matrix polymer solution comprises at least about 35 percent by weight of water, more preferably at least about 40 percent by weight of water. This level of water ensures that the matrix-forming polymer is sufficiently dissolved so that a homogeneous solution is provided.

Preferably, the matrix polymer solution comprises at least about 40 percent by weight of the matrix-forming polymer, more preferably at least about 45 percent by weight of the matrix-forming polymer. This level of the matrix-forming polymer has been found to provide a more stable aerosol-generating solution.

The matrix-forming polymer may be a single polymer or a combination of two or more polymers, wherein the one or more polymers are capable of forming a cross-linked matrix through an ionotropic gelation mechanism in a cross-linking solution of multivalent cations. The cross-linking of the matrix-forming polymer is achieved through reaction of the polymer with multivalent cations in the cross-linking solution, which form salt bridges to cross-link the polymer molecules.

Suitable matrix-forming polymers would be known to the skilled person. Preferably, the matrix-forming polymer comprises one or more polysaccharides, such as alginate or pectin, or a combination thereof. Particularly preferably, the matrix-forming polymer is alginate. Polysaccharides are particularly suitable for use in the present invention, since they can be made water insoluble and heat stable through cross-linking, and are tasteless. There is therefore no adverse impact on the sensory properties of the aerosol generated from the aerosol-generating element.

Alternative matrix-forming polymers suitable for use in methods according to the invention include but are not limited to chitosan, fibrin, collagen, gelatin, hyaluronic acid, dextran and combinations thereof.

Alternative matrix-forming polymers suitable for use in methods according to the invention may be built from one or more of the following monomers and polymers: hydroxyethylmethacryate (HEMA), N-(2-hydroxy propyl)methacrylate (HPMA), N-vinyl-2-pyrrolidone (NVP), N-isopropylacrylamide (NIPAMM), vinyl acetate (VAc), acrylic acid (AA), methacrylic acid (MAA), polyethylene glycol acrylate/methacrylate (PEGA/PEGMA) and polyethylene glycol diacrylate/dimethacrylate, (PEGDA/PEGDMA).

After formation of the matrix polymer solution as described above, the plurality of aerosol-generating formulation components are added to the matrix polymer solution to form an aerosol-generating solution. The aerosol-generating formulation components comprise at least one alkaloid or cannabinoid and a polyhydric alcohol. Preferably, the aerosol-generating formulation components further comprise an acid. These components are discussed in more detail below. The aerosol-generating solution is therefore a solution containing the matrix-forming polymer as well as the aerosol-generating formulation components.

Preferably, the aerosol-generating solution comprises at least about 1 percent by weight of the matrix-forming polymer from the matrix polymer solution, more preferably at least about 1.5 percent by weight of the matrix-forming polymer and more preferably at least about 2 percent by weight of the matrix-forming polymer.

Preferably, the aerosol-generating solution comprises less than about 6 percent by weight of the matrix-forming polymer from the matrix polymer solution, more preferably less than about 5 percent by weight of the matrix-forming polymer and more preferably less than about 4 percent by weight of the matrix-forming polymer.

For example, the aerosol-generating solution may comprise between about 1 percent by weight and about 6 percent by weight of the matrix-forming polymer, or between about 1.5 percent by weight and about 5 percent by weight of the matrix-forming polymer, or between about 2 percent by weight and about 4 percent by weight of the matrix-forming polymer.

For example, in preferred embodiments, the aerosol-generating solution may comprise between about 1 percent by weight and about 6 percent by weight of alginate, or between about 1.5 percent by weight and about 5 percent by weight of alginate, or between about 2 percent by weight and about 4 percent by weight of alginate.

The aerosol-generating formulation components may be added individually and sequentially to the matrix polymer solution. In some cases, it may be desirable to control the order or sequence in which the components are added to the matrix polymer solution in order to control the viscosity of the aerosol-generating solution, as discussed in more detail below.

Alternatively, two or more of the aerosol-generating formulation components may be combined together prior to being added to the matrix polymer solution, wherein the combination of the aerosol-generating formulation components is then added to the matrix polymer solution. All of the aerosol-generating formulation components may be combined together prior to the addition to the matrix polymer solution, or only some of the aerosol-generating formulation components may be combined together, with others being added to the matrix polymer solution individually and separately. In this latter case, the order of the addition of the aerosol-generating formulation components may still be controlled as discussed herein.

In one preferred embodiment of the invention, the aerosol-generating solution is formed by adding a liquid nicotine formulation to the matrix polymer solution, wherein the liquid nicotine formulation comprises nicotine and a polyhydric alcohol. Optionally, the liquid nicotine formulation further comprises an acid. The liquid nicotine formulation may be in the form of an e-liquid formulation, for example. Where a liquid nicotine formulation is added to the matrix polymer solution, an additional amount of nicotine, or acid, or both nicotine and acid, may be subsequently added to the matrix polymer solution in order to produce the aerosol-generating solution. In this case, the order of the addition of the liquid nicotine formulation and the additional nicotine and acid may be controlled as discussed above. For example, where an additional amount of an acid is added to the matrix polymer solution, the acid is preferably added after the liquid nicotine formulation and any additional nicotine. Advantageously, this embodiment may provide a method for incorporating a tobacco extract into the matrix polymer solution so that it is incorporated into the aerosol-generating element.

In certain embodiments of the invention, it may be desirable to control the viscosity of aerosol-generating solution. This may include controlling the viscosity of the matrix polymer solution as the aerosol-generating formulation components are added. For example, depending upon the technique used for producing the discrete portion of the aerosol-generating solution in the subsequent step of the method, it may be preferable to provide the aerosol-generating solution with a viscosity within a specific range. Different techniques are likely to be facilitated by different viscosity solutions and an appropriate viscosity should therefore be determined depending upon the technique used.

In embodiments in which the discrete portion of the aerosol-generating solution is produced in a gravitational dripping process, as described below, the viscosity of the solution is preferably retained below about 5000 mPa·s. This enables droplets of the aerosol-generating solution to be formed under gravity and also allows the beads to reach a stable shape in the cross-linking solution before the cross-linking hardens the solution and fixes the final shape of the aerosol-generating element.

For a gravitational dipping method, the viscosity of the aerosol-generating solution is preferably between about 100 mPa·s (milliPascal-seconds) and about 4000 mPa·s, more preferably between about 2500 mPa·s and about 3000 mPa·s. For the purposes of the present invention, the viscosity of the aerosol-generating solution may be measured using a torque rotational viscometer such as Fungilab Viscolead ADV(L) with the following parameters: volume of liquid 10 mL, temperature 25 degrees Celsius, rotational speed 10-15 rpm. A suitable test method for the measurement of viscosity is described in ASTM D2983-19 "Standard Test Method for Low Temperature Viscosity of Automatic Transmission Fluids, Hydraulic Fluids, and Lubricants using a Rotational Viscometer".

In certain embodiments, in order to control the viscosity of the aerosol-generating solution it may be preferably to control the pH of the matrix polymer solution whilst the aerosol-generating formulation components are being added. This is because for some matrix polymer solutions, the pH may affect the viscosity. For example, in embodiments of the invention in which the matrix-forming polymer comprises alginate, it is preferable to retain the pH of the solution above pH4. This is intended to avoid any gelling of the alginate, which may occur at pH levels below pH4, for example, due to hydrogen bonding. Such gelling at a low pH would cause an undesirable increase in the viscosity of the aerosol-generating solution, which would make it difficult to use certain techniques such as gravitational dripping, in order to form the aerosol-generating element.

In such embodiments where it is preferable to control the pH of the matrix polymer solution as the aerosol-generating formulation components are being added, the aerosol-generating formulation components are preferably added sequentially in order to retain the pH above a specific pH value. For example, where the matrix-forming polymer comprises alginate, the aerosol-generating formulation components are preferably added sequentially in order to retain the pH of the matrix polymer solution above pH4, as discussed above. Where the aerosol-generating formulation components comprise an acid, the acid is preferably added last in order to keep the pH of the matrix polymer solution at a relatively high level. Preferably, where the aerosol-generating formulation components comprise nicotine, the nicotine is added first in order to obtain a basic pH of the matrix polymer solution before the other aerosol-generating formulation are added.

Alternatively or in addition, the viscosity of the aerosol-generating solution may be controlled by adjusting the concentration of the solution. For example, the proportion of water in the aerosol-generating solution may be adjusted in order to adjust the viscosity. Preferably, the aerosol-generating solution comprises at least about 35 percent by weight of water in order to maintain a suitable viscosity. Particularly preferably, the aerosol-generating solution comprises between about 35 percent by weight and about 65 percent by weight of water.

According to a preferred embodiment of the present invention there is provided a method of producing an aerosol-generating element comprising the steps of: preparing a matrix polymer solution comprising a matrix-forming polymer in water; adding a plurality of aerosol-generating formulation components to the matrix polymer solution to form an aerosol-generating solution, wherein the aerosol-generating formulation components comprise a polyhydric alcohol, at least one alkaloid or cannabinoid and an acid and wherein the aerosol-generating formulation components are added sequentially to the matrix polymer solution such that the acid is added after the other aerosol-generating components; forming one or more droplets of the aerosol-generating solution; dropping the one or more droplets of the aerosol-generating solution into a cross-linking solution of multivalent cations to cross-link the matrix-forming polymer, thereby forming an aerosol-generating element having a continuous polymer matrix and an aerosol-generating formulation comprising the aerosol-generating formulation components dispersed within the continuous polymer matrix; and removing the aerosol-generating element from the cross-linking solution and drying the aerosol-generating element.

The method as defined forms an aerosol-generating element having a continuous polymer matrix and an aerosol-generating formulation comprising the aerosol-generating formulation components dispersed within the continuous polymer matrix.

As defined above, the aerosol-generating solution comprises a polyhydric alcohol as one of the aerosol-generating formulation components. The polyhydric alcohol acts as the aerosol former of the aerosol-generating element.

Polyhydric alcohols suitable for use in the aerosol-generating element include, but are not limited to, propylene glycol, triethylene glycol, 1,3-butanediol, and glycerin. Preferably, in an aerosol-generating element produced in accordance with the invention the polyhydric alcohol is selected from the group consisting of glycerin, propylene glycol, and combinations thereof. In particularly preferred embodiments the polyhydric alcohol is glycerin.

The concentration of the polyhydric alcohol in the aerosol-generating solution is selected such that the level of the polyhydric alcohol in the final aerosol-generating element is sufficiently high to produce an acceptable aerosol. Preferably, the aerosol-generating solution comprises at least about 20 percent by weight of a polyhydric alcohol, more preferably at least about 25 percent by weight of a polyhydric alcohol, more preferably at least about 30 percent by weight of a polyhydric alcohol, more preferably at least about 35 percent by weight of a polyhydric alcohol.

Preferably, the aerosol-generating solution comprises less than about 60 percent by weight of a polyhydric alcohol, more preferably less than about 55 percent by weight of a polyhydric alcohol, more preferably less than about 50 percent by weight of a polyhydric alcohol, more preferably less than about 45 percent by weight of a polyhydric alcohol.

For example, the aerosol-generating solution may comprise between about 20 percent by weight and about 60 percent by weight of a polyhydric alcohol, or between about 25 percent by weight and about 55 percent by weight of a polyhydric alcohol, or between about 30 percent by weight and about 50 percent by weight of a polyhydric alcohol, or between about 35 percent by weight and about 45 percent by weight of a polyhydric alcohol.

As defined above, the aerosol-generating solution further comprises at least one alkaloid or cannabinoid compound as one of the aerosol-generating formulation components.

As used herein with reference to the invention, the term "alkaloid compound" describes any one of a class of naturally occurring organic compounds that contain one or more basic nitrogen atoms. Generally, an alkaloid contains at least one nitrogen atom in an amine-type structure. This or another nitrogen atom in the molecule of the alkaloid compound can be active as a base in acid-base reactions. Most alkaloid compounds have one or more of their nitrogen atoms as part of a cyclic system, such as for example a heterocylic ring. In nature, alkaloid compounds are found primarily in plants, and are especially common in certain families of flowering plants. However, some alkaloid compounds are found in animal species and fungi. In the context of the present invention, the term "alkaloid compounds" is used to describe both naturally derived alkaloid compounds and synthetically manufactured alkaloid compounds.

Preferably, the alkaloid is selected from the group consisting of: nicotine, anatabine and combinations thereof.

As used herein with reference to the invention, the term "cannabinoid compound" describes any one of a class of naturally occurring compounds that are found in parts of the *Cannabis* plant—namely the species *Cannabis sativa, Cannabis indica*, and *Cannabis ruderalis*. Cannabinoid compounds are especially concentrated in the female flower heads. Cannabinoid compounds naturally occurring in the *cannabis* plant include tetrahydrocannabinol (THC) and cannabidiol (CBD). In the context of the present invention, the term "cannabinoid compounds" is used to describe both naturally derived cannabinoid compounds and synthetically manufactured cannabinoid compounds.

Preferably, the aerosol-generating formulation components comprise a cannabinoid compound selected from the group consisting of: tetrahydrocannabinol (THC), tetrahydrocannabinolic acid (THCA), cannabidiol (CBD), cannabidiolic acid (CBDA), cannabinol (CBN), cannabigerol (CBG), cannabigerol monomethyl ether (CBGM), cannabivarin (CBV), cannabidivarin (CBDV), tetrahydrocannabivarin (THCV), cannabichromene (CBC), cannabicyclol (CBL), cannabichromevarin (CBCV), cannabigerovarin (CBGV), cannabielsoin (CBE), cannabicitran (CBT) and combinations thereof.

In general, the level of the alkaloid compound or cannabinoid compound in the aerosol-generating solution may be selected such that the aerosol-generating element comprises up to about 10 percent by weight of an alkaloid compound or a cannabinoid compound or both. The content of alkaloid compound or cannabinoid compound or both in the aerosol-generating element may be increased and adjusted with a view to optimising the delivery of alkaloid compound or cannabinoid compound or both in aerosol form to the consumer. Compared with existing aerosol-generating substrates based on the use of plant material, this may advantageously allow for higher contents of alkaloid compound or cannabinoid compound or both per volume of substrate or per weight of substrate, which may be desirable from a manufacturing viewpoint.

Preferably, the aerosol-generating solution comprises at least about 0.5 percent by weight of an alkaloid compound or a cannabinoid compound or both. Thus, the aerosol-generating solution preferably comprises at least about 0.5 percent by weight of an alkaloid compound or at least 0.5 percent by weight of a cannabinoid compound or at least about 0.5 percent by weight of a combination of an alkaloid compound and a cannabinoid compound.

More preferably, the aerosol-generating solution comprises at least about 1 percent by weight of an alkaloid compound or a cannabinoid compound or both, more preferably at least about 2 percent by weight of an alkaloid compound or a cannabinoid compound or both. The aerosol-generating solution preferably comprises less than about 10 percent by weight of an alkaloid compound or a cannabinoid compound or both, more preferably less than about 8 percent by weight of an alkaloid compound or a cannabinoid compound or both, more preferably less than about 6 percent by weight of an alkaloid compound or a cannabinoid compound or both.

For example, the aerosol-generating solution may comprise from about 0.5 percent by weight to about 10 percent by weight of an alkaloid compound or a cannabinoid compound or both, or from about 1 percent by weight to about 8 percent by weight of an alkaloid compound or a cannabinoid compound or both, or from about 2 percent by weight to about 6 percent by weight of an alkaloid compound or a cannabinoid compound or both.

In some embodiments, the aerosol-generating formulation components comprise one or more of a cannabinoid and an alkaloid compound comprising nicotine or anatabine. In some preferred embodiments, the aerosol-generating solution comprises nicotine.

As used herein with reference to the invention, the term "nicotine" is used to describe nicotine, a nicotine base or a nicotine salt. In embodiments in which the aerosol-generating formulation components comprise a nicotine base or a nicotine salt, the amounts of nicotine recited herein are the amount of free base nicotine or amount of protonated nicotine, respectively.

The aerosol-generating formulation components may comprise natural nicotine or synthetic nicotine.

The aerosol-generating formulation components may comprise one or more monoprotic nicotine salts.

As used herein with reference to the invention, the term "monoprotic nicotine salt" is used to describe a nicotine salt of a monoprotic acid.

Preferably, the aerosol-generating solution comprises at least about 0.5 percent by weight nicotine. More preferably, the aerosol-generating solution comprises at least about 1 percent by weight nicotine. Even more preferably, the aerosol-generating solution comprises at least about 2 percent by weight nicotine. In addition, or as an alternative, the aerosol-generating solution preferably comprises less than about 10 percent by weight nicotine. More preferably, the aerosol-generating solution comprises less than about 8 percent by weight nicotine. Even more preferably, the aerosol-generating solution comprises less than about 6 percent by weight nicotine. For example, the aerosol-generating solution may comprise between about 0.5 percent by weight and about 10 percent by weight nicotine, or between about 1 percent by weight and about 8 percent by weight nicotine, or between about 2 percent by weight and about 6 percent by weight nicotine.

Preferably, the amount of nicotine in the aerosol-generating solution is adjusted to provide an aerosol-generating element that comprises at least about 0.5 milligrams of nicotine, more preferably at least about 1 milligram of nicotine, more preferably at least about 1.5 milligrams of nicotine, more preferably at least about 2 milligrams of nicotine, and most preferably at least about 2.5 milligrams of nicotine.

The aerosol-generating element may comprise up to about 6 milligrams of nicotine. Preferably, the amount of nicotine in the aerosol-generating solution is therefore adjusted to provide an aerosol-generating element comprising less than or equal to about 6 milligrams of nicotine, more preferably less than or equal to about 5 milligrams of nicotine, more preferably less than or equal to about 4 milligrams of nicotine, more preferably less than or equal to about 3.5 milligrams of nicotine, and most preferably less than or equal to about 3 milligrams of nicotine.

In some preferred embodiments, the aerosol-generating formulation components comprise a cannabinoid compound. Preferably, the cannabinoid compound is selected from CBD and THC. More preferably, the cannabinoid compound is CBD.

The aerosol-generating solution may comprise up to about 10 percent by weight of CBD. Preferably, the aerosol-generating solution comprises at least about 0.5 percent by weight CBD, more preferably at least about 1 percent by weight CBD, more preferably at least about 2 percent by weight CBD. Preferably, the aerosol-generating solution preferably comprises less than about 8 percent by weight CBD, more preferably less than about 6 percent by weight CBD.

For example, the aerosol-generating solution may comprise from about 0.5 percent by weight to about 10 percent by weight CBD, more preferably from about 1 percent by weight to about 8 percent by weight CBD, even more preferably from about 2 percent by weight to about 6 percent by weight CBD.

As described above, in preferred embodiments of the invention, the aerosol-generating formulation components further comprise an acid.

More preferably, the aerosol-generating formulation components comprise one or more organic acids. Even more preferably, the aerosol-generating formulation components comprise one or more carboxylic acids.

Suitable carboxylic acids for use in the aerosol-generating formulation of aerosol-generating elements in accordance with the present invention include, but are not limited to: 2-Ethylbutyric acid, acetic acid, adipic acid, benzoic acid, butyric acid, cinnamic acid, cycloheptane-carboxylic acid, fumaric acid, glycolic acid, hexanoic acid, lactic acid, levulinic acid, malic acid, myristic acid, octanoic acid, oxalic acid, propanoic acid, pyruvic acid, succinic acid, and undecanoic acid.

In particularly preferred embodiments, the acid is lactic acid or levulinic acid or benzoic acid or levulinic acid or fumaric acid or acetic acid. Most preferably, the acid is lactic acid. The inclusion of an acid is especially preferred in embodiments in which the aerosol-generating formulation components comprise nicotine, as it has been observed that the presence of an acid may stabilise dissolved species in the aerosol-generating solution, such as with nicotine and other plant extracts. Without wishing to be bound by theory, it is understood that the acid may interact with the nicotine molecule, such that protonated nicotine is stabilised. As protonated nicotine is non-volatile, it is more easily found in the liquid or particulate phase rather than in the vapour phase of an aerosol obtained by heating the aerosol-generating element. As such, the loss of nicotine during manufacturing of the aerosol-generating element can be minimised, and higher, better controlled nicotine delivery to the consumer can advantageously be ensured.

Preferably, the aerosol-generating solution comprises at least about 0.5 percent by weight of the acid. More preferably, the aerosol-generating solution comprises at least about 1 percent by weight of the acid. Even more preferably, the aerosol-generating solution comprises at least about 2 percent by weight of the acid. In addition, or as an alternative, the aerosol-generating solution preferably comprises less than about 10 percent by weight of the acid. More preferably, the aerosol-generating solution comprises less than about 8 percent by weight of the acid. Even more preferably, the aerosol-generating solution comprises less than about 6 percent by weight of the acid.

For example, the aerosol-generating solution may comprise between about 0.5 percent by weight and about 10 percent by weight of the acid, or between about 1 percent by weight and about 8 percent by weight of the acid, or between about 2 percent by weight and about 6 percent by weight of the acid.

Preferably, where the aerosol-generating solution comprises nicotine, the molar ratio of the acid to nicotine is between about 0.5:1 and about 2:1, more preferably between about 0.75:1 and about 1.5:1, most preferably about 1:1.

Where a multivalent acid is used, such as a multivalent carboxylic acid, it may be preferable to provide a molar ratio of the acid groups to nicotine of between about 0.5:1 and about 2:1, more preferably between about 0.75:1 and about 1.5:1, most preferably about 1:1. The use of a multivalent acid therefore enables a lower weight amount of the acid to be used whilst still providing the same level of protonation of the nicotine.

The aerosol-generating formulation components included in the aerosol-generating solution may optionally further comprise a flavourant. The flavourant may be in liquid form, or solid form. Optionally, the flavourant may be provided in a microencapsulated form wherein the flavourant is released upon heating. Preferably, the amount of the flavourant in the aerosol-generating solution is adjusted in order to provide the desired level of flavourant within the aerosol-generating element. Preferably, the aerosol-generating element has a level of flavourant between about 0.05 percent by weight and about 1 percent by weight, more preferably between about 0.1 percent by weight about 0.5 percent by weight.

Suitable flavourants for use as an aerosol-generating formulation components in the present invention include but are not limited to: tobacco, menthol, mint such as peppermint or spearmint, cocoa, liquorice, fruit (such as citrus), gamma octalactone, vanillin, spices (such as cinnamon), methyl salicylate, linalool, eugenol, eucalyptol, bergamot oil, eugenol oil, geranium oil, lemon oil, ginger oil, and tobacco flavour.

Optionally, the aerosol-generating solution may further comprise a plurality of susceptor particles. Susceptor particles are conductive particles that have the ability to convert electromagnetic energy and convert it to heat. When located in an alternating electromagnetic field, eddy currents are induced and hysteresis losses occur in the susceptor particles causing heating of the susceptor. As the susceptor particles are located in thermal contact or close thermal proximity with the aerosol-generating formulation of the aerosol-generating element, the aerosol-generating formulation is heated by the susceptor particles such that an aerosol is formed.

The inclusion of susceptor particles in the aerosol-generating solution therefore provides an aerosol-generating element that is inductively heatable. When the aerosol-generating element is used in a device comprising an induction heater, changing electromagnetic fields generated by one or several induction coils of an inductive heating device heats the susceptor particles, which then transfer the heat to the surrounding aerosol-generating formulation of the aerosol-generating element, mainly by conduction of heat.

The susceptor particles may be formed from any material that can be inductively heated to a temperature sufficient to generate an aerosol from the aerosol-generating formulation. Preferred susceptor particles comprise a metal or carbon. Preferred susceptor particles may comprise or consist of a ferromagnetic material, for example a ferromagnetic alloy, ferritic iron, or a ferromagnetic steel or stainless steel. Suitable susceptor particles may be, or comprise, aluminium. Preferred susceptor particles may be heated to a temperature in excess of 250 degrees Celsius. Suitable susceptor particles may comprise a non-metallic core with a metal layer disposed on the non-metallic core, for example metallic tracks formed on a surface of a ceramic core. Susceptor particles may have a protective external layer, for example a protective ceramic layer or protective glass layer encapsulating the susceptor particle. The susceptor particles may comprise a protective coating formed by a glass, a ceramic, or an inert metal, formed over a core of susceptor material.

The susceptor particles may have an average particle size up to about 60 micrometres. For example, the susceptor particles may have an average particle size of less than or equal to about 50 micrometres, or less than or equal to about 40 micrometres or less than or equal to about 35 micrometres.

Typically, in an aerosol-generating solution for use in methods in accordance with the present invention the susceptor particles have an average particle size of at least about 1 micrometre, or at least about 2 micrometres, or at least about 5 micrometres or at least about 10 micrometres.

For example, the susceptor particles in the aerosol-generating solution may have an average particle size from about 1 micrometre to about 60 micrometres, or from about 2 millimetres to about 50 micrometres, or from about 5 micrometres to about 40 micrometres, or from about 10 micrometres to about 35 micrometres.

Optionally, a solid filler may additionally be added to the aerosol-generating solution. The inclusion of a solid filler may advantageously improve the physical properties of the resultant aerosol-generating element. A solid filler may also be used in order to control the properties of the aerosol-generating solution during the process of forming a discrete portion of the aerosol-generating solution. Suitable solid fillers would be known to the skilled person.

For example, in certain embodiments of the present invention, the aerosol-generating solution further comprises particles of plant material obtained by pulverising, grinding or comminuting plant material. By way of example, the aerosol-generating solution may further comprise tea particles, coffee particles, *Cannabis* particles, clove particles, *Eucalyptus* particles, star anise particles or ginger particles. Additionally or alternatively, the aerosol-generating solution may further comprise tobacco particles obtained by pulverising, grinding or comminuting one or more of tobacco leaf lamina and tobacco leaf stems. The inventors of the present invention have found that through the incorporation of such plant particles into the aerosol-generating element it is advantageously possible to produce an aerosol with provides a novel sensory experience. Such an aerosol provides unique flavours and may provide an increased level of mouthfullness.

In embodiments wherein the aerosol-generating solution comprises plant particles, the amount of the plant particles in the aerosol-generating solution is adjusted in order to provide the desired level of the plant particles within the aerosol-generating element and the desired level of flavour within the generated aerosol. The aerosol-generating element may comprise up to about 40 percent by weight of plant particles. Preferably, the aerosol-generating element comprises less than or equal to about 35 percent by weight of plant particles. More preferably, the aerosol-generating element comprises less than or equal to about 30 percent by weight of plant particles. Even more preferably, the aerosol-generating element comprises less than or equal to about 25 percent by weight of plant particles.

In some embodiments, the aerosol-generating element comprises at least about 1 percent by weight of plant particles. Preferably, the aerosol-generating element comprises at least about 2 percent by weight of plant particles. More preferably, the aerosol-generating element comprises at least about 5 percent by weight of plant particles. Even more preferably, the aerosol-generating element comprises at least about 10 percent by weight of plant particles.

For example, the aerosol-generating substrate may comprise between about 1 percent by weight and about 40 percent by weight of plant particles, more preferably between about 2 percent by weight and about 35 percent by weight of plant particles, more preferably between about 5 percent by weight and about 30 percent by weight of plant particles and most preferably between about 10 percent by weight and about 25 percent by weight of plant particles.

The provision of an amount of plant particles within this range ensures that sufficient flavour can be achieved from the plant particles but without affecting the consistency of the aerosol-generating solution so much that processing of the aerosol-generating solution to form the aerosol-generating element is adversely affected.

In embodiments wherein the aerosol-generating solution comprises plant particles, the plant particles may have an average particle size up to about 60 micrometres. Preferably, the plant particles have an average particle size of less than or equal to about 50 micrometres, more preferably less than or equal to about 40 micrometres and most preferably less than or equal to about 35 micrometres.

Typically, in an aerosol-generating solution for use in methods in accordance with the present invention the plant particles have an average particle size of at least about 1 micrometre, more preferably at least about 2 micrometres, more preferably at least about 5 micrometres and most preferably at least about 10 micrometres.

For example, the plant particles in the aerosol-generating solution may have an average particle size from about 1 micrometre to about 60 micrometres, more preferably from about 2 millimetres to about 50 micrometres, more preferably from about 5 micrometres to about 40 micrometres, most preferably from about 10 micrometres to about 35 micrometres.

In the next step of the method according to the invention, after formation of the aerosol-generating solution, a discrete portion of the aerosol-generating solution is formed. The "discrete portion" of the solution corresponds to a specific volume of the solution, which is typically processed in order to provide an aerosol-generating element with a specific shape and size. The discrete portion of the aerosol-generating solution may be formed into a variety of shapes, depending upon the desired form of the aerosol-generating element. For example, the aerosol-generating solution may be formed into spherical or cylindrical shapes in order to produce droplets, beads or threads of the material. Alternatively, the aerosol-generating solution may be formed into a sheet, cut into strips or flakes, or drawn into an elongate filament or yarn.

In particularly preferred embodiments of the invention, the step of forming a discrete portion of the aerosol-generating solution comprises forming a droplet. Preferably, a droplet of the aerosol-generating solution is formed using a dripping process in which the aerosol-generating solution is dripped from an extrusion orifice or nozzle. The nozzle may optionally be connected to a pump. Particularly preferably, a droplet of the aerosol-generating solution is formed using a gravitational dripping process in which each droplet falls from the extrusion nozzle under gravity only. Alternatively, the extrusion nozzle may be vibrated in order to assist the formation and release of a droplet.

In preferred embodiments of the invention in which a droplet is formed using a dripping process, the diameter of the droplet can be adjusted through adjustment of the diameter of the extrusion nozzle or the viscosity of the aerosol-generating solution, or both. Preferably, an extrusion nozzle having an opening with a diameter of between about 0.5 mm and about 6 mm is preferred, to produce an aerosol-generating element having an appropriate size for use in an aerosol-generating article or system.

Typically, in such embodiments, once released from the extrusion nozzle, the droplet falls under gravity into the cross-linking solution. Preferably, the droplet is formed at a height of at least 0.1 metres above the cross-linking solution. This minimum dripping height is advantageous, for example, where a spherical droplet is desired, since it ensures that the droplet falls a sufficient distance for a spherical shape to form. Preferably, the droplet is formed at a height of less than 0.6 metres above the cross-linking solution so as to minimise any deformation of the droplet before it enters the cross-linking solution.

In certain embodiments, a dripping process may be combined with a jet break up process, which breaks up the droplet or stream of the aerosol-generating solution as it leaves the nozzle, in order to form smaller droplets. For example, jet cutting apparatus such as a rotating disk may be provided underneath the extrusion nozzle to break up the aerosol-generating solution into droplets. This type of process is particularly suitable where aerosol-generating elements having a relatively small diameter are desired.

Alternatively, an electrostatic extrusion process may be used in which the flow of the aerosol-generating solution from the extrusion nozzle is broken apart by electrostatic charge. As with the jet cutting process, electrostatic extrusion may be particularly suitable for the preparation of aerosol-generating elements having a relatively small diameter. As a further alternative, the aerosol-generating solution may be broken up by vibrational means provided at or close to the nozzle.

As discussed above, the desired viscosity of the aerosol-generating solution depends to a certain extent upon the selected process of forming the discrete portion of the aerosol-generating solution. Suitable ranges of viscosity have been indicated for a gravitational dripping process. Jet cutting may be suitable for aerosol-generating solutions with a relatively high viscosity, for example, above 200 mPa·s. In contrast, electrostatic extrusion may be more suitable for aerosol-generating solutions with a low viscosity, for example, below 200 mPa·s.

Once formed, the discrete portion of the aerosol-generating solution, which is preferably in the form of a droplet, is added to a cross-linking solution of multivalent cations. This causes the matrix-forming polymer to cross-link thereby forming a solid, continuous polymer matrix, as described above. The cross-linking solution preferably comprises a solution of a multivalent metal salt, such as solution of a metal chloride. Preferred multivalent cations include calcium, iron, aluminium, manganese, copper, zinc or lanthanum. A particularly preferred salt is calcium chloride.

In certain preferred embodiments of the invention in which the aerosol-generating solution comprises an acid, the calcium salt provided in the cross-linking solution may advantageously be a salt of the same acid. For example, in embodiments in which the aerosol-generating solution comprises lactic acid, the cross-linking solution may advantageously comprise calcium lactate.

Where the aerosol-generating solution comprises nicotine, the acid in the aerosol-generating solution forms a nicotine salt with the nicotine. The use of a calcium salt corresponding to the acid in the aerosol-generating solution therefore provides the same salt in the cross-linking solution as in the aerosol-generating solution. This, in turn, advantageously limits the diffusion of nicotine salts out of the aerosol-generating solution into the cross-linking solution during the cross-linking step. A higher concentration of the nicotine salt can therefore be retained within the aerosol-generating element. Furthermore, any potential waste of the nicotine and acid during the production of the aerosol-generating element can be reduced.

Preferably, the cross-linking solution comprises between about 0.5 percent by weight and about 10 percent by weight of the multivalent metal salt in the cross-linking solution.

Preferably, the cross-linking step is carried out without heating, for example at room temperature (22 degrees Celsius). The duration of time over which the discrete portion of the aerosol-generating solution is left in the cross-linking solution may be selected depending upon the degree of cross-linking desired in the aerosol-generating element. In certain preferred embodiments, the discrete portion of the aerosol-generating solution is left in the cross-linking solution for between about 10 minutes and about 30 minutes.

Preferably, the cross-linking solution further comprises a polyhydric alcohol, which is the same as the polyhydric alcohol selected as the aerosol-generating formulation component. The inclusion of the polyhydric alcohol in the cross-linking solution has been found to limit diffusion of the polyhydric alcohol from the aerosol-generating solution into the cross-linking solution during the cross-linking step. This advantageously enables a higher concentration of the polyhydric alcohol to be retained within the aerosol-generating element than has been previously possible. In addition, the reduced diffusion of the polyhydric alcohol into the cross-linking solution may advantageously help to maintain the shape of the aerosol-generating element during the cross-linking process.

Preferably, the cross-linking solution comprises between about 20 percent by weight and about 60 percent by weight of the polyhydric alcohol, more preferably between about 30 percent by weight and about 50 percent by weight of the polyhydric alcohol.

As discussed above, the polyhydric alcohol in the cross-linking solution is selected to match the polyhydric alcohol in the aerosol-generating solution. In preferred embodiments, the polyhydric alcohol is glycerin.

In particularly preferred embodiments of the present invention, the concentration of the polyhydric alcohol within the cross-linking solution is adjusted depending on the concentration of that polyhydric alcohol within the aerosol-generating solution. In particular, it is desirable that the concentration of the polyhydric alcohol within the cross-linking solution is as close as possible to the concentration of the same polyhydric alcohol within the aerosol-generating solution. This has been found to optimise the beneficial effects of including the polyhydric alcohol in the cross-linking solution, as described above.

Preferably, the concentration of the polyhydric alcohol in the cross-linking solution is within about 20 percent of the concentration of the same polyhydric alcohol in the aerosol-generating solution, more preferably within about 15 percent and more preferably within about 10 percent. In particularly preferred embodiments, the concentration of the polyhydric alcohol in the cross-linking solution is approximately equal to the concentration of the same polyhydric alcohol in the aerosol-generating solution After cross-linking, the resultant aerosol-generating element is removed from the cross-linking solution, for example, using a sieve or similar apparatus. The aerosol-generating element is preferably rinsed to remove the cross-linking solution from the surface. The aerosol-generating element is then dried in order to reduce the water content to the desired level.

Preferably, the drying of the aerosol-generating element is carried out to reduce the water content of the aerosol-generating element to less than about 20 percent by weight, more preferably less than about 15 percent by weight. This level of water is preferred for the aerosol-generating element in order to generate the aerosol in an efficient way upon heating of the aerosol-generating element during use.

Preferably, the drying of the aerosol-generating element is carried out to reduce the water activity ($a_w$) of the aerosol-generating element to less than about 0.7, more preferably less than about 0.5. This advantageously reduces the likelihood of proliferation of bacteria and fungi in the aerosol-generating element.

The term "water activity" is used herein with reference to the present invention to denote the ratio of the partial water vapour pressure in equilibrium with an aerosol-generating element to the water-vapour saturation pressure in equilibrium with pure water at the same temperature. As such, water activity is a dimensionless quantity between 0, which corresponds to a completely anhydrous substance, and 1, which corresponds to pure salt-free water. Methods of measuring the water activity of an aerosol-generating element in accordance with the present invention are described in the 2017 publication of ISO 18787 (Foodstuffs—Determination of water activity). Preferably, the dew-point measurement principle as described in ISO 18787 is used.

The drying of the aerosol-generating element may be carried out using any suitable means, including for example in a dryer in which the aerosol-generating element is heated. The time and temperature of the drying step may be adjusted depending upon the apparatus used and in order to achieve the desired water level. For example, the aerosol-generating element may be dried at 25 degrees Celsius for 12 hours, or at 100 degrees Celsius for 3 hours. The drying may optionally be carried out under vacuum.

The method according to the present invention may further comprise a step of coating the aerosol-generating element to provide an outer coating layer on the aerosol-generating element. The coating step may take place before the drying step, or after the drying step. An optional drying step may be incorporated after the coating step.

The provision of a coating layer on the aerosol-generating element may be desirable for many different reasons. For example, a coating layer may advantageously limit the permeation of oxygen or water vapour into the aerosol-generating element, which may help to extend the shelf life of the aerosol-generating element. Alternatively or in addition, a coating layer may help to protect the structural integrity of the aerosol-generating element, or to provide improved smoothness of the aerosol-generating element. In certain embodiments, a relatively brittle coating layer may be added to the aerosol-generating element that is adapted to be broken by the consumer prior to use. This type of coating layer can therefore provide the consumer with a tactile and audible indication that the aerosol-generating element has been activated. Alternatively or in addition, the provision of a coating layer on the aerosol-generating element may be used to adjust the colour of the aerosol-generating element, for example, to provide a visual indication of a property of the aerosol-generating element, such as the flavour or the content of nicotine.

Suitable types of coating material would be known to the skilled person. For example, a coating layer of a water soluble film former, such as HPMC or shellac, may be applied to the aerosol-generating element. Such film formers will adhere strongly to the surface of the aerosol-generating element. In a further example, a coating layer of sodium alginate may be added, which will cross-link with any remaining calcium ions on the surface of the aerosol-generating element to form a thin film of calcium alginate.

A coating layer may be applied to the outer surface of the aerosol-generating element using a variety of coating techniques. Suitable apparatus and techniques would be known to the skilled person.

The method of the present invention has been described in relation to the production of a single aerosol-generating element. However, it would be clear to the skilled person that the present invention also encompasses methods for the production of a plurality of aerosol-generating elements. The method as described could be readily adapted by the skilled person to produce a plurality of aerosol-generating elements, for example, in a batch process in which a plurality of discrete portions of the aerosol-generating solution are produced and added simultaneously to the cross-linking solution, or in a continuous process in which discrete portions of the aerosol-generating solution are continuously produced and added into the cross-linking solution.

The method of the present invention produces an aerosol-generating element having a distinct structure. As defined above, the aerosol-generating element comprises a continuous polymer matrix and an aerosol-generating formulation dispersed within the continuous polymer matrix wherein the aerosol-generating formulation is trapped within the continuous polymer matrix.

Without wishing to be bound by theory, it is understood that in an aerosol-generating element in accordance with the present invention a three-dimensional polymeric matrix structure is formed by cross-linking, and aerosol-generating formulation is retained within the continuous polymeric matrix structure. This is, in particular, in contrast with existing core/shell structures wherein a content of the core is released upon rupturing the shell.

The compounds that may be incorporated into the aerosol-generating element and the preferred amounts of these compounds are described above in relation to the method of the present invention.

Preferably, the aerosol-generating formulation dispersed within the solid continuous matrix structure accounts for at least about 70 percent by weight of a total weight of the aerosol-generating element or even at least about 75 percent by weight of a total weight of the aerosol-generating element or at least about 80 percent by weight of a total weight of the aerosol-generating element.

More preferably, the aerosol-generating formulation dispersed within the solid continuous polymer matrix accounts for at least about 82 percent by weight of a total weight of the aerosol-generating element. Even more preferably, the aerosol-generating formulation dispersed within the continuous polymer matrix accounts for at least about 84 percent by weight of a total weight of the aerosol-generating element.

In particularly preferred embodiments, the aerosol-generating formulation dispersed within the continuous polymer matrix accounts for at least about 86 percent by weight of a total weight of the aerosol-generating element. More preferably, the aerosol-generating formulation dispersed within the continuous polymer matrix accounts for at least about 88 percent by weight of a total weight of the aerosol-generating element. Even more preferably, the aerosol-generating formulation dispersed within the continuous polymer matrix accounts for at least about 90 percent by weight of a total weight of the aerosol-generating element.

Most preferably, the aerosol-generating formulation dispersed within the continuous polymer matrix accounts for at least about 92 percent by weight of a total weight of the aerosol-generating element or at least about 93 percent by weight of a total weight of the aerosol-generating element or at least about 94 percent by weight of a total weight of the aerosol-generating element or at least about 95 percent by weight of a total weight of the aerosol-generating element.

In aerosol-generating elements wherein the aerosol-generating formulation accounts for a fraction of the overall weight of the aerosol-generating element within the ranges described above, it is advantageously possible to minimise the portion of heat supplied to the aerosol-generating element during use that is consumed for increasing the temperature of the encapsulation material. As such, a more efficient use of the heat supplied to the aerosol-generating element is made possible, such that the great majority of said heat is effectively employed for releasing the aerosol-formulation components from the continuous polymer matrix and the generation of an aerosol.

As defined above, an aerosol-generating element in accordance with the invention comprises a polyhydric alcohol as a component of the aerosol-generating formulation dispersed within the continuous polymer matrix. An aerosol-generating element according to the present invention preferably comprises at least about 30 percent by weight of the polyhydric alcohol, more preferably at least about 40 percent by weight of the polyhydric alcohol, more preferably at least about 50 percent by weight of the polyhydric alcohol, more preferably at least about 60 percent by weight of the polyhydric alcohol, more preferably at least about 70 percent by weight of the polyhydric alcohol, based on the total weight of the aerosol-generating element.

Typically, in an aerosol-generating element in accordance with the invention the polyhydric alcohol content in the aerosol-generating formulation accounts for less than or equal to about 95 percent by weight based on the total weight of the aerosol-generating element.

As defined above, in an aerosol-generating element in accordance with the invention, the continuous polymer matrix is formed by a matrix-forming polymer that has been cross-linked. Preferably, the aerosol-generating element comprises at least about 2 percent by weight of the matrix-forming polymer, more preferably at least about 2.5 percent by weight of the matrix-forming polymer and more preferably at least about 3 percent by weight of the matrix-forming polymer. Preferably, the aerosol-generating element comprises less than about 6 percent by weight of the matrix-forming polymer, more preferably less than about 5 percent by weight of the matrix-forming polymer, more preferably less than about 4.5 percent by weight of the matrix-forming polymer. For example, the aerosol-generating element may comprise between about 2 percent by weight and about 6 percent by weight of the matrix-forming polymer, or between about 2.5 percent by weight and about 5 percent by weight of the matrix-forming polymer, or between about 3 percent by weight and about 4.5 percent by weight of the matrix-forming polymer.

As defined above, in an aerosol-generating element in accordance with the present invention the aerosol-generating formulation dispersed within the continuous polymer matrix comprises at least one alkaloid or cannabinoid compound. In some embodiments, the aerosol-generating formulation dispersed within the continuous polymer matrix comprises both an alkaloid compound and a cannabinoid compound.

In general, the aerosol-generating element may comprise up to about 10 percent by weight of an alkaloid compound or a cannabinoid compound or both. In view of applications of the aerosol-generating element of the invention as a substrate in an aerosol-generating article, this is advantageous as the content of alkaloid compound or cannabinoid compound or both in the element may be increased and adjusted with a view to optimising the delivery of alkaloid compound or cannabinoid compound or both in aerosol form to a consumer. Compared with existing aerosol-generating substrates based on the use of plant material, this may advantageously allow for higher contents of alkaloid compound or cannabinoid compound or both per volume of substrate (element or elements) or per weight of substrate (element or elements), which may be desirable from a manufacturing viewpoint.

Preferably, the content of the at least one alkaloid or cannabinoid compound in the aerosol-generating formulation dispersed within the continuous polymer matrix accounts for at least 0.5 percent by weight of a total weight of the aerosol-generating element. Thus, the aerosol-generating element preferably comprises at least about 0.5 percent by weight of an alkaloid compound or at least 0.5 percent by weight of a cannabinoid compound or at least about 0.5 percent by weight of a combination of an alkaloid compound and a cannabinoid compound.

More preferably, the aerosol-generating element comprises at least about 1 percent by weight of an alkaloid compound or a cannabinoid compound or both. Even more preferably, the aerosol-generating element comprises at least about 2 percent by weight of an alkaloid compound or a cannabinoid compound or both.

The aerosol-generating element preferably comprises less than about 8 percent by weight of an alkaloid compound or a cannabinoid compound or both. More preferably, the aerosol-generating element comprises less than about 6 percent by weight of an alkaloid compound or a cannabinoid compound or both. Even more preferably, the aerosol-generating element comprises less than about 5 percent by weight of an alkaloid compound or a cannabinoid compound or both. Most preferably, the aerosol-generating element comprises less than about 4 percent by weight of an alkaloid compound or a cannabinoid compound or both.

In some embodiments, the aerosol-generating element comprises from about 0.5 percent by weight to about 10 percent by weight of an alkaloid compound or a cannabinoid compound or both, more preferably from about 1 percent by weight to about 10 percent by weight of an alkaloid compound or a cannabinoid compound or both, even more preferably from about 2 percent by weight to about 10 percent by weight of an alkaloid compound or a cannabinoid compound or both.

As described above in relation to the method of the present invention, in some preferred embodiments, the aerosol-generating element comprises nicotine.

In general, the aerosol-generating element may comprise up to about 10 percent by weight of nicotine. In view of applications of the aerosol-generating element of the invention as a substrate in an aerosol-generating article, this is advantageous as the content of nicotine in the aerosol-generating element may be increased and adjusted with a view to optimising the delivery of nicotine in aerosol form to a consumer. Compared with existing aerosol-generating substrates based on the use of tobacco plant, this may advantageously allow for higher contents of nicotine per volume of substrate (element or elements) or per weight of substrate (element or elements), which may be desirable from a manufacturing viewpoint.

Preferably, the aerosol-generating element comprises at least about 0.5 percent by weight of nicotine. More preferably, the aerosol-generating element comprises at least about 1 percent by weight of nicotine. Even more preferably, the aerosol-generating element comprises at least about 2 percent by weight of nicotine.

The aerosol-generating element preferably comprises less than or equal to about 8 percent by weight of nicotine. More preferably, the aerosol-generating element comprises less than or equal to about 6 percent by weight of nicotine. Even more preferably, the aerosol-generating element comprises less than or equal to about 5 percent by weight of nicotine. Most preferably, the aerosol-generating element comprises less than or equal to about 4 percent by weight of nicotine.

In some embodiments, the aerosol-generating element comprises from about 0.5 percent by weight to about 10 percent by weight of nicotine, more preferably from about 1 percent by weight to about 10 percent by weight of nicotine, even more preferably from about 2 percent by weight to about 10 percent by weight of nicotine.

Preferably, the aerosol-generating element comprises at least about 0.5 milligrams of nicotine. More preferably, the aerosol-generating element comprises at least about 1 milligram of nicotine. Even more preferably, the aerosol-generating element comprises at least about 1.5 milligrams of nicotine. In particularly preferred embodiments, the aerosol-generating element comprises at least about 2 milligrams of nicotine, and most preferably at least about 2.5 milligrams of nicotine.

The aerosol-generating element may comprise up to about 6 milligrams of nicotine. Preferably, the aerosol-generating element comprises less than or equal to about 5 milligrams of nicotine. More preferably, the aerosol-generating element comprises less than or equal to about 4.5 milligrams of nicotine. Even more preferably, the aerosol-generating element comprises less than or equal to about 4 milligrams of nicotine. In particularly preferred embodiments, the aerosol-generating element comprises less than or equal to about 3.5 milligrams of nicotine, and most preferably less than or equal to about 3 milligrams of nicotine.

In some preferred embodiments, the aerosol-generating formulation dispersed within the continuous polymer matrix of the aerosol-generating element comprises a cannabinoid compound. Preferably, the cannabinoid compound is selected from CBD and THC. More preferably, the cannabinoid compound is CBD.

The aerosol-generating element may comprise up to about 10 percent by weight of CBD. Preferably, the aerosol-generating element comprises at least about 0.5 percent by weight of CBD. More preferably, the aerosol-generating element comprises at least about 1 percent by weight of CBD. Even more preferably, the aerosol-generating element comprises at least about 2 percent by weight of CBD.

The aerosol-generating element preferably comprises less than or equal to about 6 percent by weight of CBD. More preferably, the aerosol-generating element comprises less than or equal to about 5 percent by weight of CBD. Even more preferably, the aerosol-generating element comprises less than or equal to about 4 percent by weight CBD.

In some embodiments, the aerosol-generating element comprises from about 0.5 percent by weight to about 10 percent by weight of CBD, more preferably from about 1 percent by weight to about 10 percent by weight of CBD, even more preferably from about 2 percent by weight to about 10 percent by weight of CBD.

An aerosol-generating element in accordance with the present invention may be a substantially tobacco-free aerosol-generating element.

As used herein with reference to the invention, the term "substantially tobacco-free aerosol-generating element" describes an aerosol-generating element having a tobacco content of less than 1 percent by weight. For example, the aerosol-generating element may have a tobacco content of less than about 0.75 percent by weight, less than about 0.5 percent by weight or less than about 0.25 percent by weight.

The aerosol-generating element may be a tobacco-free aerosol-generating element.

As used herein with reference to the invention, the term "tobacco-free aerosol-generating element" describes an aerosol-generating element having a tobacco content of 0 percent by weight.

As described above, in some embodiments, the aerosol-generating formulation dispersed within the continuous polymer matrix further comprises an acid.

The aerosol-generating element may comprise up to about 10 percent by weight of an acid.

Preferably, the aerosol-generating element comprises at least about 0.5 percent by weight of an acid. More preferably, the aerosol-generating element comprises at least about 1 percent by weight of an acid. Even more preferably, the aerosol-generating element comprises at least about 2 percent by weight of an acid.

The aerosol-generating element preferably comprises less than or equal to about 8 percent by weight of an acid. More preferably, the aerosol-generating element comprises less than or equal to about 6 percent by weight of an acid. Even more preferably, the aerosol-generating element comprises less than or equal to about 5 percent by weight of an acid. Most preferably, the aerosol-generating element comprises less than or equal to about 4 percent by weight of an acid.

In some embodiments, the aerosol-generating element comprises from about 0.5 percent by weight to about 10 percent by weight of an acid, more preferably from about 1 percent by weight to about 10 percent by weight of an acid, even more preferably from about 2 percent by weight to about 10 percent by weight of an acid.

An aerosol-generating element according to the present invention preferably comprises less than or equal to about 25 percent by weight of water.

More preferably, the aerosol-generating element comprises less than or equal to about 20 percent by weight of water. Even more preferably, the aerosol-generating element comprises less than or equal to about 15 percent of water.

An aerosol-generating element according to the present invention preferably comprises at least about 2.5 percent by weight of water. More preferably, the aerosol-generating element according to the present invention preferably comprises at least about 5 percent by weight of water. Even more preferably, the aerosol-generating element according to the present invention preferably comprises at least about 7.5 percent by weight of water. Most preferably, the aerosol-generating element according to the present invention preferably comprises at least about 10 percent by weight of water.

In general, it has been observed that the presence of some water contributes to imparting desirable stability to the aerosol-generating element. At the same time, a residual content of water of 25 percent by weight or less is desirable as an aerosol-generating element may be obtained that is substantially not sticky. Further, when heating an aerosol-generating element with a lower water content, an aerosol more concentrated in the polyhydric alcohol and in the alkaloid or cannabinoid compound, such as nicotine, may be provided to the consumer.

An aerosol-generating element in accordance with the invention may have an equivalent diameter of at least about 0.5 millimetres.

The term "equivalent diameter of an aerosol-generating element" is used herein to denote the diameter of the sphere which has the same volume as the aerosol-generating element. In general, the aerosol-generating element may have any shape, although a spherical or quasi-spherical shape, such as an egg shape or ellipsoid shape is preferred. For an aerosol-generating element having a spherical shape and a circular transverse cross-section, the equivalent diameter is the diameter of the cross-section of the aerosol-generating element.

Preferably, the aerosol-generating element has an equivalent diameter of at least about 1 millimetre. More preferably, the aerosol-generating element has an equivalent diameter of at least about 2 millimetres. Even more preferably, the aerosol-generating element has an equivalent diameter of at least about 3 millimetres.

An aerosol-generating element in accordance with the invention preferably has an equivalent diameter of less than or equal to about 8 millimetres. More preferably, the aerosol-generating element has an equivalent diameter of less than or equal to about 6 millimetres. Even more preferably, the aerosol-generating element has an equivalent diameter of less than or equal to about 5 millimetres.

In some embodiments, the aerosol-generating element has an equivalent diameter from about 0.5 millimetres to about 8 millimetres, preferably from about 1 millimetre to about 8 millimetres, more preferably from about 2 millimetres to about 8 millimetres, even more preferably from about 3 millimetres to about 8 millimetres.

In particularly preferred embodiments, the aerosol-generating element has an equivalent diameter of about 4 millimetres or about 4.5 millimetres.

Aerosol-generating elements in accordance with the present invention may have an ovality up to about 35 percent.

The term "ovality" as used herein with reference to the present invention denotes the degree of deviation from a perfect circle. Ovality is expressed as a percentage and the mathematical definition is given below.

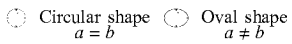

$$\text{ovality}(\%) = \frac{2(a-b)}{a+b} \times 100\%$$

To determine the ovality of an object, such as an aerosol-generating element, the object can be viewed along a direction substantially perpendicular to a cross-section of the aeroso-generating element. By way of example, the aerosol-generating element can be positioned on a transparent stage so that an image of the aerosol-generating element is recorded by a suitable imaging device located below the stage. Dimension "a" is taken to be the largest external diameter of the image of the aerosol-generating element, and dimension "b" is taken to be the smallest external diameter of the image of the aerosol-generating element. The process is repeated for a total of ten aerosol-generating elements having the same composition and prepared by means of the same process and under the same operating conditions. The number average of the ten ovality measurements is recorded as the ovality for that aerosol-generating element.

Preferably, an aerosol-generating element in accordance with the invention has an ovality of less than or equal to about 30 percent. More preferably, an aerosol-generating element in accordance with the invention has an ovality of less than or equal to about 25 percent. Even more preferably, an aerosol-generating element in accordance with the invention has an ovality of less than or equal to about 20 percent.

An aerosol-generating element in accordance with the invention typically has an ovality of at least about 1 percent. Preferably, the aerosol-generating element has an ovality of at least 2 percent. More preferably, the aerosol-generating element has an ovality of at least 3 percent. Even more preferably, the aerosol-generating element has an ovality of at least 4 percent.

In some embodiments, the aerosol-generating element has an ovality from about 1 percent to about 30 percent, more preferably from about 2 percent to about 30 percent, more preferably from about 3 percent to about 30 percent, even more preferably from about 4 percent to about 30 percent.

An aerosol-generating article in accordance with the present invention may have an exposed surface area to volume ratio up to 25 $cm^{-1}$.

The expression "exposed surface area to volume ratio" as used herein with reference to the present invention denotes the ratio between the overall outer surface area of the aerosol-generating element, that is exposed and available for heat and mass exchange, and the overall volume of the aerosol-generating element.

As the aerosol-generating elements in accordance with the invention have low ovality and may be assimilated to spherical objects, the volume of an aerosol-generating element in accordance with the invention can be expressed by the formula $$\text{volume} = \frac{4\pi \cdot (R_{eq})^3}{3}$$

The exposed surface area of an aerosol-generating element in accordance with the invention can be estimated by the formula $$\text{exposed surface area}=4\pi\cdot(R_{eq})^2$$

Dimension $R_{eq}$ denotes an equivalent radius of the aerosol-generating element.

Preferably, the aerosol-generating article has an exposed surface area to volume ratio of at least about 0.083 $cm^{-1}$. More preferably, the aerosol-generating article has an exposed surface area to volume ratio of at least about 0.166 $cm^{-1}$. Even more preferably, the aerosol-generating article has an exposed surface area to volume ratio of at least about 0.249 $cm^{-1}$.

The aerosol-generating article preferably has an exposed surface area to volume ratio of less than or equal to about 24 $cm^{-1}$. More preferably, the aerosol-generating article has an exposed surface area to volume ratio of less than or equal to about 20 $cm^{-1}$. Even more preferably, the aerosol-generating article has an exposed surface area to volume ratio of less than or equal to about 16 $cm^{-1}$.

In some embodiment, the aerosol-generating article has an exposed surface area to volume ratio from about 0.083 $cm^{-1}$ to about 24 $cm^{-1}$, more preferably from about 0.166 $cm^{-1}$ to about 24 $cm^{-1}$, even more preferably from about 0.249 $cm^{-1}$ to about 24 $cm^{-1}$.

In some embodiments, aerosol-generating elements in accordance with the present invention may be coated, as described above in relation to the method of the present invention.

Aerosol-generating elements as described above may find use as aerosol-generating substrate for aerosol-generating articles of the type wherein the substrate is heated to release an inhalable aerosol—as opposed to articles wherein a substrate is burned to produce a smoke.

Because aerosol-generating elements in accordance with the invention are easy to manufacture and predetermined, discrete amounts of an aerosol-generating formulation may thus be provided in encapsulated form, and because the composition of the aerosol-generating formulation—especially as regards the content of polyhydric alcohol and of the alkaloid or cannabinoid compound—can be finely tuned and controlled, aerosol-generating elements in accordance with the invention are versatile and can be used as substrates in a number of arrangements.

By way of example, a plurality of aerosol-generating elements in accordance with the invention may be provided within a cavity defined by a tubular element, such that the outer surface of the aerosol-generating elements is exposed inside the longitudinal airflow channel defined by the cavity. Upon heating, an aerosol can be generated from the aerosol-generating elements, which is thus released into the airflow channel and can be drawn through the tubular element into the consumer's mouth.

Aerosol-generating elements as described above may thus find use in an aerosol-generating system comprising one or more aerosol-generating elements or an aerosol-generating article as described above and an electrically operated aerosol-generating device. A suitable aerosol-generating device comprises a heating element and a heating chamber configured to receive the one or more aerosol-generating elements or the article so that the one or more aerosol-generating element elements are heated in the heating chamber by the heating element.

Upon heating, aerosol-generating elements in accordance with the present invention release an aerosol containing the aerosol-generating formulation components, including in particular the polyhydric alcohol and the alkaloid or cannabinoid compound. When an aerosol-generating element in accordance with the present invention is heated to a temperature in the range from about 150 degrees Celsius to about 350 degrees Celsius, the aerosol-generating element has been found to lose weight without undergoing a significant volume contraction. Further, it has been found that, when an aerosol-generating element in accordance with the present invention is heated to a temperature in the range from about 150 degrees Celsius to about 350 degrees Celsius, and heat is supplied until no additional weight loss is detected, a residual weight of the aerosol-generating element is typically less than 120 percent of a weight of the continuous polymer matrix components, preferably less than 115 percent of a weight of the continuous polymer matrix components, more preferably less than 115 percent of a weight of the continuous polymer matrix components, even more preferably less than 105 percent of a weight of the continuous polymer matrix components.

Most preferably, when an aerosol-generating element in accordance with the present invention is heated to a temperature in the range from about 150 degrees Celsius to about 350 degrees Celsius, and heat is supplied until no additional weight loss is detected, a residual weight of the aerosol-generating element substantially corresponds to the total weight of the components of the continuous polymer matrix.

An embodiment of the invention will now be further described, by way of example only.

EXAMPLE

An aerosol-generating solution is formed from a mixture of the following components:

| Component | % by weight |
|---|---|
| Glycerin | 43.6 |
| Sodium alginate | 2.1 |
| Nicotine | 1.2 |
| Levulinic acid | 1.4 |
| Water | 51.7 |

In an initial step, the sodium alginate is added to the water to form a matrix polymer solution. The nicotine is then added, followed by the glycerin and finally the levulinic acid.

The resultant aerosol-generating solution is extruded through a 5 millimetre nozzle to form a plurality of droplets, which are then dropped from a height of 30 centimetres into a cross-linking solution having the following composition, at room temperature:

| Component | % by weight |
|---|---|
| Glycerin | 42.9 |
| Water | 52.1 |
| Calcium chloride | 5.0 |

The droplets are left in the cross-linking solution for a period of 25 minutes before being removed and dried at 25 degrees Celsius for 12 hours, in a tray dryer. The resultant dried aerosol-generating elements are in the form of solid, spherical beads having a diameter of about 4.6 mm. Each bead has a weight of approximately 65 mg, a water activity of 0.4 and the following composition:

| Component | % by weight |
|---|---|
| Glycerin | 76.8 |
| Alginate | 3.8 |
| Nicotine | 2.4 |
| Levulinic acid | 2.1 |
| Water | 14.4 |
| Calcium chloride | 0.5 |

The invention claimed is:

1. A method of producing an aerosol-generating element for an aerosol-generating article or system, the method comprising the steps of:

preparing a matrix polymer solution comprising a matrix-forming polymer in water;

adding a plurality of aerosol-generating formulation components to the matrix polymer solution to form an aerosol-generating solution, wherein the aerosol-generating formulation components comprise a polyhydric alcohol and at least one alkaloid or cannabinoid, and wherein the aerosol-generating solution comprises at least 0.5 percent by weight of the at least one alkaloid or cannabinoid;

forming a discrete portion of the aerosol-generating solution;

adding the discrete portion of the aerosol-generating solution to a cross-linking solution of multivalent cations to cross-link the matrix-forming polymer wherein the cross-linking solution comprises at least 20 percent by weight of a polyhydric alcohol, and wherein the polyhydric alcohol in the cross-linking solution is the same as the polyhydric alcohol in the aerosol-generating solution; and removing the aerosol-generating element from the cross-linking solution and drying the aerosol-generating element.

2. The method according to claim 1, wherein the aerosol-generating formulation components further comprise an acid.

3. The method according to claim 1, wherein the step of forming the discrete portion of the aerosol-generating solution comprises forming a droplet of the aerosol-generating solution, and wherein the droplet is dropped into the cross-linking solution from a height of at least 10 cm.

4. The method according to claim 1, wherein the viscosity of the aerosol- generating solution is below about 5000 mPa·s.

5. The method according to claim 1, wherein the aerosol-generating formulation components are added sequentially to the matrix polymer solution.

6. The method according to claim 1, wherein the aerosol-generating solution further comprises at least 20 percent by weight of the polyhydric alcohol.

7. The method according to claim 1, wherein the polyhydric alcohol in the aerosol-generating solution is glycerin, propylene glycol, or a combination of glycerin and propylene glycol.

8. The method according to claim 1, wherein the aerosol-generating solution further comprises at least 0.5 percent by weight of nicotine.

9. The method according to claim 1, wherein the matrix-forming polymer comprises alginate, and wherein the matrix polymer solution comprises at least 45 percent by weight of water.

10. The method according to claim 1, wherein a concentration of the polyhydric alcohol in the cross-linking solution is within 20 percent of a concentration of the polyhydric alcohol within the aerosol-generating solution.

11. The method according to claim 1, wherein during the drying step, the water content of the aerosol-generating element is reduced to less than 20 percent by weight.

12. The method according to claim 1, wherein after the drying step, the aerosol-generating element has a polyhydric alcohol content of at least 60 percent by weight.

* * * * *